United States Patent [19]

Lewis

[11] 4,191,795

[45] Mar. 4, 1980

[54] METHOD AND MEANS FOR TREATING TIMBERS

[76] Inventor: Jesse M. Lewis, 4410 S. Mingo Rd., Tulsa, Okla. 74145

[21] Appl. No.: 936,619

[22] Filed: Aug. 24, 1978

[51] Int. Cl.[2] ..... B05D 3/12; B05D 1/18

[52] U.S. Cl. ..... 427/351; 118/50; 118/58; 118/64; 118/404; 118/405; 118/421; 427/440

[58] Field of Search ..... 427/351, 440, 397; 118/50, 421, 58, 64, 48, 49, 404, 405

[56] References Cited

U.S. PATENT DOCUMENTS

| | | | |
|---|---|---|---|
| 3,922,397 | 11/1975 | Baymiller | 427/351 X |
| 4,086,056 | 4/1978 | Hanson | 427/440 X |

*Primary Examiner*—Michael R. Lusignan
*Attorney, Agent, or Firm*—Head & Johnson

[57] ABSTRACT

A method and apparatus for treating timbers, such as railroad ties and the like, which comprises at least one pressure sealed tube or pipe filled with the treating fluid normally utilized for treating timbers, and of a size for receiving the timbers in sequential end-to-end relation for longitudinal movement therethrough. The timbers are initially loaded into the treating pipe through one end thereof from a movable tube containing a single timber therein, with the single timber being ejected from the movable tube into the treating tube by a suitable ram member, such as a hydraulic piston. As timber after timber is introduced into the fluid filled treating pipe, each timber pushes the preceding timber longitudinally through the pipe and the timbers absorb the treating fluid during the longitudinal passage through the filled pipe. The timbers are sequentially removed from the opposite end of the filled pipe and are individually inserted into a second movable tube whereupon the treated timber is transferred into a vacuum chamber for drying of the timber. The treated and dried timbers are then discharged from the apparatus for storage.

21 Claims, 6 Drawing Figures

METHOD AND MEANS FOR TREATING TIMBERS

BACKGROUND OF THE INVENTION

1. Field of the Invention

This invention relates to improvements in method and means for treating timbers and more particularly, but not by way of limitation, to a method and means for treating railroad ties, and the like.

2. Description of the Prior Art

It is highly desirable to treat or impregnate timbers, as for example railroad ties, with a suitable preservative material, such as creosote or the like, in order to lengthen the useful life of the timbers. At the present time, the most common method of treating or coating railroad ties comprises carrying of the ties on a locomotive along a railroad track to the vicinity of a large treating vessel. The vessel is filled with a supply of the coating material, which is normally in a liquid state, and is provided with a plurality of trucks or rollers therein for receiving a plurality of the ties. The ties are loaded longitudinally into the vessel and flat in the liquid contained therein. The trucks disposed within the vessel facilitate the movement of the ties longitudinally therethrough whereby the ties absorb the treating fluid, and are subsequently removed from the tank or vessel in a coated or treated state. A boiler is usually provided for producing steam which is directed through the vessel for heating of the coating or treating material and suitable pumping equipment is normally interposed between the vessel and a treating fluid holding tank in order that the treating fluid may be introduced into and withdrawn from the vessel. When the ties have been in the treating vessel a sufficient length of time for absorbing a sufficient quantity of the treating fluid, the fluid is removed from the vessel, and a vacuum is produced in the interior of the vessel for facilitating drying of the coating ties contained therein. The ties thus treated and dried are removed from the vessel, and the process is repeated with the next batch of ties. This method and means of treating ties has many disadvantages in that the treating vessel is of an enormous size, and the auxiliary equipment, such as the locomotive for delivery of the ties to the vessel, and the rails for travel of the locomotive are expensive.

SUMMARY OF THE INVENTION

The present invention contemplates a novel method and means for coating or treating timbers which has been particularly developed and constructed for overcoming the foregoing disadvantages. The novel method comprises the insertion of a single timber, such as a railroad tie into a tube of an appropriate size and length for receiving the tie therein. The loaded tube is then moved into alignment with a pressure sealed elongated tube filled with the treating fluid, and of a diameter substantially corresponding to the diameter of the loading tube. A pressure lock is opened between the aligned tubes whereby a ram member ejects the raw tie from the loading tube into the treating tube in a longitudinal direction. Succeeding raw timbers or ties are similarly loaded into the treating tube in end-to-end relation whereby a tie pushes the preceding tie longitudinally through the treating tube. As the ties move through the treating tube in the longitudinal direction, they absorb the treating fluid, and a receiving tube similar to the loading tube is provided at the discharge end of the treating tube for sequentially receiving the coated or treated ties therein. The receiving tube, loaded with a treated tie, is then moved into substantial alignment with a vacuum tube and the tie is ejected from the receiving tube and inserted into the vacuum tube by a suitable ram in a manner similar to the loading of the treating tube. Tie after tie is inserted into the vacuum tube in end-to-end relation for moving the preceding ties longitudinally therethrough, and a final ejection tube receives the coated and dried ties individually from the vacuum tube for discharge from the system for storage. The novel apparatus and method is simple and efficient in operation and economical and durable in construction.

DESCRIPTION OF THE PREFERRED EMBODIMENT

Figure 1:
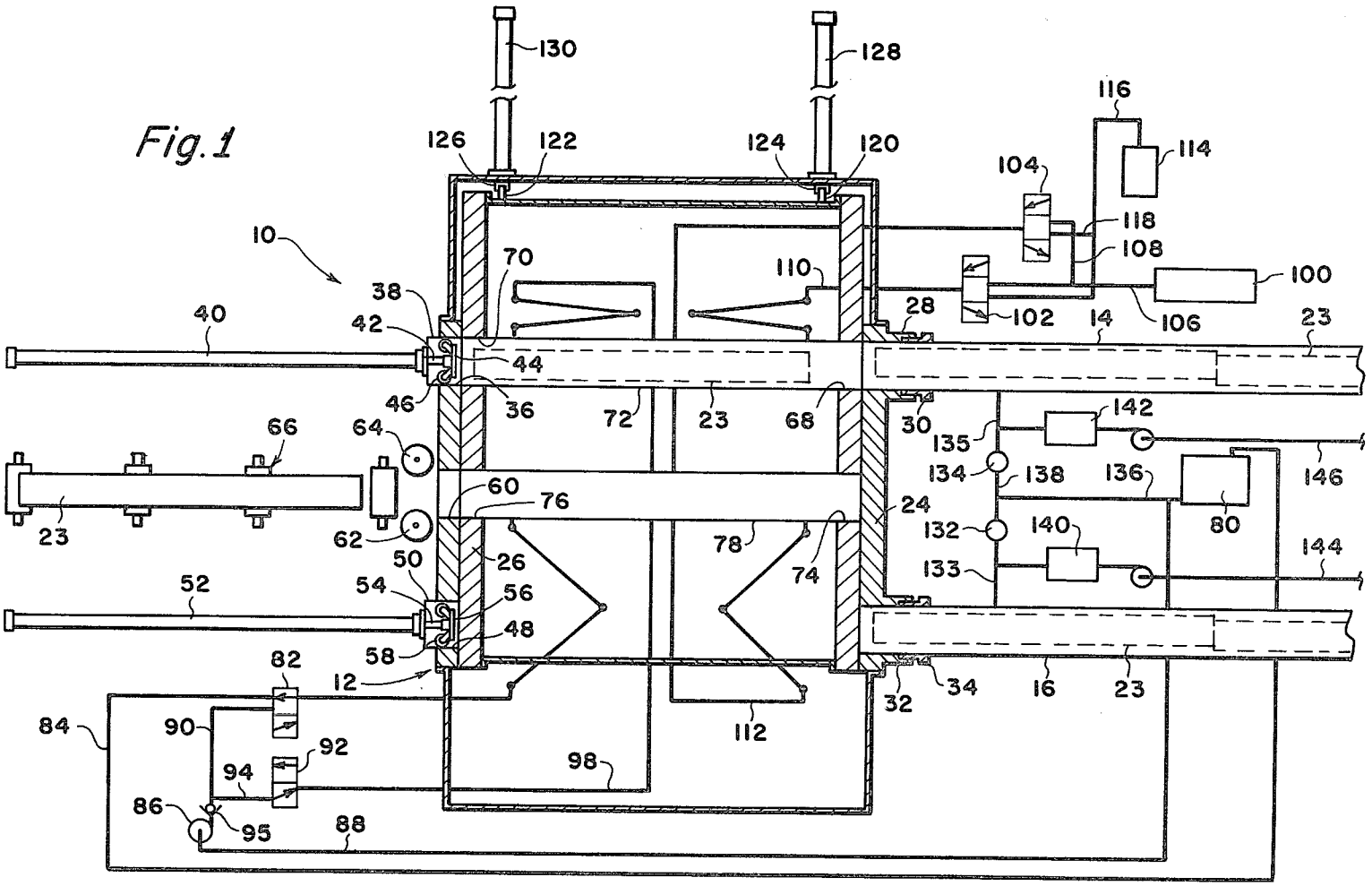
FIG. 1 is a plan view, partly in section, of the loading portion of a timber treating apparatus embodying the invention and illustrating one operational position thereof.

Referring to the drawings in detail, reference character 10 generally indicates a timber treating apparatus comprising an injection chamber assembly 12 which supports one end of a pair of treating tubes or chambers 14 and 16 in a manner as will be hereinafter set forth. The treating tubes 14 and 16 are filled with a suitable treating fluid, such as creosote (not shown), and the opposite ends of the tubes 14 and 16 are supported by a receiving chamber 18 which is generally similar to the injection chamber assembly 12. In addition, a vacuum tube or chamber 20 is also supported at one end by the receiving chamber 18 terminates in a discharge cylinder 22.

Briefly stated, timbers, such as railroad ties 23, are initially loaded into the injection chamber 12 whereupon the timbers are injected into one of the treating tubes 14 or 16. The timbers 23 are conveyed longitudinally through the respective treating tube and float in the fluid contained therein whereby the fluid is absorbed by the timbers. When the treated timbers reach the opposite end of the treating tube, they are received in the receiving chamber 18 and directed into the vacuum tube 20 for drying. The dried timbers are ultimately directed into the discharge cylinder 22 and are released from the treating apparatus for storage.

The injection chamber 12 comprises an outer housing 24 having an inner housing 26 slidably disposed therein. A first boss member 28 is provided in the sidewall of the outer housing 24 for receiving one end of the tube 14 therein and a suitable expansion joint 30 is interposed between the outer end of the boss 28 and the pipe for facilitating retaining of the pipe therein in a leakproof or pressure sealed manner. A second boss member 32 is spaced from the boss 28 for receiving one end of the tube 16 therein and a second expansion joint 34 is similarly interposed between the boss 32 and the tube 16 for sealingly containing the tube 16 with respect to the boss 32. A first port 36 is provided in the housing 24 oppositely disposed with respect to the boss 28 and in substantial axial alignment therewith. The outer end of the port 36 is suitably sealed by a cap member generally indicated at 38, and a suitable hydraulic cylinder 40, or the like, is mounted on the outer end of the cap 38 in any well known manner (not shown) whereby the reciprocal rod member 42 thereof extends through the cap 38 for connection with a piston head or ram member 44. The ram member 44 is preferably mounted on a plurality of circumferentially spaced rollers 46 for a purpose as will be hereinafter set forth. Of course, suitable sealing means (not shown) is provided between the cap 38 and the outer periphery of the rod 42 for precluding leakage of fluid therebetween, as is well known.

A second port 48 similar to the port 36 is provided in the outer housing 24 oppositely disposed with respect to the boss 32 and in substantial axial alignment therewith and the outer end of the port 48 is closed or sealed by a suitable cap member generally indicated at 50. A second hydraulic cylinder 52, or the like, is secured to the outer end of the cap member 50 in any well known manner (not shown) whereby the reciprocal rod member 54 thereof extends through the cap 50 into connection with a suitable piston head or ram member 56. The ram member 56 is preferably supported by or mounted on a plurality of circumferentially spaced rollers 58 for a purpose as will be hereinafter set forth.

A third port 60 is provided in the housing 24 and is substantially centrally disposed between the ports 36 and 48, and the outer end thereof is open, as particularly shown in FIGS. 1 and 2 for freely receiving a timber 24 therethrough for a purpose and in a manner as will be hereinafter set forth. A pair of spaced pinch rollers 62 and 64, or the like, are secured to the outer periphery of the housing 24 in any well known manner (not shown) in the proximity of the bore 60, and a suitable conveyor apparatus generally indicated at 66 extends outwardly from the rollers 62 and 64 as particularly shown in FIGS. 1 and 2 for supporting and longitudinally moving a timber 23 in a direction toward the rollers 62 and 64 in a manner and for a purpose as will be hereinafter set forth.

A pair of oppositely disposed aligned bores 68 and 70 are provided in the walls of the slidable housing 26 for receiving the opposite ends of a tube or pipe member 72 therein to support the pipe 72 therebetween. A second pair of oppositely disposed aligned bores 74 and 76 are provided in the walls of the slidable housing 26 for receiving the opposite ends of a second tube 78 therein for supporting the tube 78 therebetween. The bores 70 and 76 are spaced apart substantially the same distance as the spacing between the bores 36 and 60, and 60 and 48 wherein in one relative position between the slidable housing 26 and the housing 24 the tube 72 will be in alignment between the bore 36 and tube 14 and the tube 78 will be in alignment with the bore 60 as shown in FIG. 1, and in a second relative position between the slidable housing 26 and the housing 24, the tube 78 will be in substantial alignment between the bore 48 and the tube 16 and the tube 72 will be in alignment with the bore 60 as shown in FIG. 2.

It is to be noted that whereas the particular embodiment of the invention depicted herein includes two treating tubes 14 and 16, it may be desirable to provide only a single treating tube, or it may be desirable to provide a greater number of treating tubes than the two shown herein.

A reservoir vessel 80 of any suitable type is provided in the proximity of the injection chamber 12 for storing an adequate supply of the treating fluid therein. The vessel 80 is in communication with a first drain/fill valve 82 through a suitable conduit 84 and is in communication with a suitable chamber fill pump 86 through a conduit 88. The pump 86 is in communication with the valve 82 through a line or conduit 90, and in communication with a second drain/fill valve 92 through a conduit or line 94. It is preferable to interpose a suitable check valve 95 between the pump 86 and valves 82 and 92 to preclude back flow of the treating fluid as is well known. The valve 92 is in communication with the interior of the tube 78 through a suitable flexible conduit 96 and the valve 92 is in communication with the interior of the tube 72 through a generally similar flexible conduit 98. In this manner, one of the tubes, such as the tube 72, may be selectively filled with the treating fluid when desired and the other tube, such as the tube 78, may be evacuated or the fluid may be removed therefrom, as desired. Conversely, of course, fluid may be directed into the interior of the tube 78 and discharged from the tube 72, all for a purpose as will be hereinafter set forth.

A suitable compressed air tank or air compressor 100 is preferably provided in the proximity of the assembly 12, and is in communication with a pair of suitable pressure venting valves 102 and 104 through lines or conduits 106, and 108, respectively. The valve 102 is in communication with the interior of the tube or pipe 72 through a suitable flexible conduit 110, and the valve 104 is in communication with the interior of the tube or pipe 78 through a generally similar flexible conduit 112. The valves 102 and 104 are also in communication with a vapor recovery vessel 114 through suitable lines 116 and 118, respectively. In this manner, the gaseous elements present in the tube 72 or 78 being filled with the treating fluid may be released from the respective tube for venting to the atmosphere, or for trapping in the vapor recovery vessel 114, as desired.

A pair of spaced connection members 120 and 122 may be suitably secured to the outer periphery of one side of the sidable housing or chamber 26, each connection member being provided for receiving one end of a reciprocal piston rod 124 and 126, respectively of suitable cylinders, such as hydraulic cylinders 128 and 130, respectively, for securing the piston rods to the slidable housing 26 for moving the housing 26 to and fro or reciprocally within the outer housing 24 during operation of the apparatus 10.

As hereinbefore set forth, in one position of the housing 26 within the housing 24, the tube 72 is disposed in alignment with the tube 14 and the tube 78 is in alignment with the port 60 as shown in FIG. 1. In this particular operation position, it is preferable to withdraw the fluid from the interior of the tube 78 prior to the alignment thereof with the port 60, thus assuring that fluid will not be accidentally discharged from the tube through the port 60. Of course, a suitable cover means (not shown) may be provided for the port 60 which may be selectively opened for providing communication with the interior of the tube disposed in alignment therewith. When this condition exists, the timber 23 carried by the conveying apparatus 66 may be moved longitudinal in a direction toward the port 60 by the conveying apparatus in any well known manner for inserting the timber 23 between the pinch rollers 62 and 64 whereby the timber 23 will be directed through the port 60 and into the interior of the tube 78.

Assuming that the tube 72 has been previously loaded with a timber 23 in the same manner as hereinbefore set forth, the tube 72 may be filled with the treating fluid by proper manipulation of the valves 82 and 92 as is well known, and the pressure within the tube 72 is equalized with the pressure in the tube 12. Then, when the tube 72 is in alignment between the tube 14 and the port 36, the ram member 44 may be activated for ejecting the timber 23 from the tube 72 and inserting the timber into the tube 14. Of course, any previously loaded timbers 23 present within the tube 14 will be moved longitudinally therethrough as the newly inserted timber abuts the outer end of the immediately previously loaded timber in the tube 14. In this manner, successive timbers 23 individually loaded into the tube 14 will be moved longitudinally through the entire length of the tube 14, and will float in the fluid contained therein for absorbing the treating fluid. The treated timbers 23 may be subsequently recovered from the tube 14 in a manner as will be hereinafter set forth.

Figure 2:
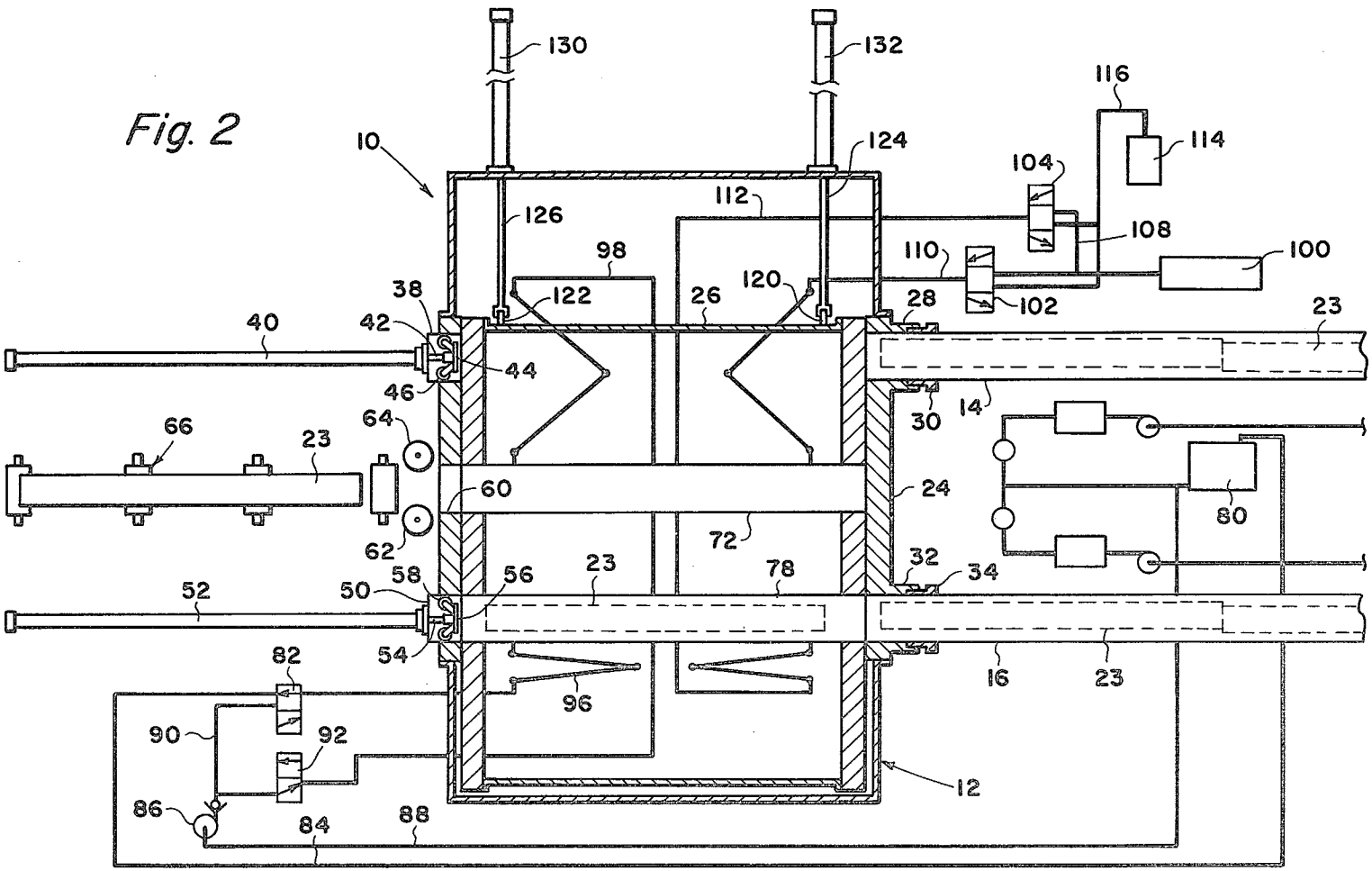
FIG. 2 is a view similar to FIG. 1 illustrating a second position of operation for the apparatus.

In another position of the slidable housing 26 within the outer housing 24, the tube 78 will be in substantial alignment with the tube 16 and the tube 72 will be in alignment with the port 60 as particularly shown in FIG. 2, whereupon the operation as hereinbefore set forth may be repeated. In this operational position of the apparatus 12, however, the timers 23 will be loaded into the tube 16 for treatment by the fluid contained therein.

A pair of suitable, fluid make up pumps 132 and 134 are in communication with the treating fluid reservoir or holding tank 80 through suitable lines 136 and 138 for receiving fluid therefrom. The pump 132 is in communication with the interior of the pipe 16 through a conduit 133 for supplying the treating fluid thereto, and the pump 134 is similarly in connection with the interior of the pipe 14 through a conduit 135 for supplying the treating fluid in the proximity of one end thereof. In addition, the pumps 132 and 134 move the treating fluid to suitable heaters 140 and 142, and the heaters 140 and 142 may be of any suitable type, such as direct fired fluid heaters. Suitable circulating pumps 144 and 146 are operably connected with the heaters 140 and 142, respectively, for pumping the fluid into lines 144 and 146, respectively, for delivering the fluid to the opposite ends of the tubes 14 and 16 as more particularly shown in FIGS. 3 and 4. Of course, the treating fluid may be constantly supplied to the tubes by circulation therethrough for maintaining and adequate quantity therein, and the fluid is maintained at the proper temperature and pressure for an optimum treating operation.

The receiving chamber 18 is generally similar to the injection chamber 12 and comprises a housing 148 having a housing 150 slidably disposed therein. The housing 150 is provided with a first boss member 152 for the opposite end of the pipe 16 therein with respect to the boss 28, and a suitable expansion joint 154 is preferably interposed between the boss 152 and pipe 16 as is well known. A second boss 156 is provided on the housing 148 in spaced relation to the boss 152 for receiving the opposite end of the pipe 14 therein with respect to the boss 32, and a suitable expansion joint 158 is preferably interposed between the boss 156 and the pipe 14 as is well known. In addition, a third boss 160 is provided in the housing 148 substantially centrally disposed between the bosses 152 and 156 for receiving one end of vacuum tube 20 therein, and a suitable expansion joint 162 is preferably interposed between the boss 160 and the tube 20 as is well known.

The housing 150 is provided with a first pair of axially aligned bores 164 and 166 for receiving the opposite ends of a pipe or tube 168 which is generally similar to the pipe 72. A second pair of axially aligned bores 170 and 172 are provided in the housing 150 spaced from the first bores 164 and 166 for receiving the opposite ends of a tube 174 therein which is generally similar to the tube 78. A pair of suitable spaced pinch rollers 176 and 178, or the like, are journalled in the proximity of the left hand end of the tube 168 as viewed in FIGS. 3 and 4 for engaging the opposite sides of a timber 23 emerging from the pipe 16 as will be hereinafter set forth. A second pair of spaced pinch rollers 180 and 182 are similarly journalled in the proximity of the left hand end of the tube 172 for engaging the opposite sides of a timer 23 contained within the tube 172 as will be hereinafter set forth. In addition, a pair of similar spaced pinch rollers 184 and 186 are suitably journalled in the proximity of the exit end of the pipe 14 and spaced from the boss 152 as particularly shown in FIGS. 3 and 4 for engaging the opposite sides of the exiting timber 23 as will be hereinafter set forth. Similarly, a pair of spaced pinch rollers 188 and 190 are journalled in the proximity of the exit end of the tube 16 and spaced from the boss 156 for engaging the opposite sides of an exiting timber 23 as will be hereinafter set forth. Similarly, a pair of spaced pinch rollers 188 and 190 are journalled in the proximity of the exit end of the tube 16 and spaced from the boss 156 for engaging the opposite sides of an exiting timber 23 as will be hereinafter set forth.

A second treating fluid reservoir or vessel 192 is provided in the proximity of the receiving chamber 18 for storing a supply of treating fluid therein, and the vessel 192 is in communication with a suitable fill pump 194 through a line or conduit 196. The pump 194 is in communication with a pair of drain/fill valves 198 and 200 through conduits 202 and 204, respectively. The valves 198 and 200 are in communication with the reservoir 192 through the conduit 206. Of course, it is preferably to interpose a suitable check valve 208 between the pump 194 and the valves 198 and 200 for precluding accidental back flow of the treating fluid, and similarly it is preferable to provide a suitable check value 210 interposed between the vessel 192 and the valves 198 and 200 for precluding back flow of the treating fluid, as is well known.

The drain/fill valve 198 is in communication with the interior of the tube 168 through a suitable flexible conduit or line 212 and the valve 200 is similarly in communication with the interior of the tube 172 through a flexible conduit 214. In this manner the treating fluid may be alternately injected into the tubes 168 and 172 and withdrawn therefrom as hereinbefore set forth.

In addition, a suitable compressed air tank or compressor 216 is provided in the proximity of the receiving chamber 18 and is in communication with a pair of pressure venting valves 218 and 220 through conduits 222 and 224. The valves 218 and 220 are also in communication with a vapor recovery vessel 226 through conduits 228 and 230, respectively. The valve 218 is in communication with the interior of the tube 168 through a suitable flexible conduit 232 for venting of the gaseous elements therefrom as the tube is filled with the treating fluid and admitting the compressed air thereto for evacuating the treating fluid therefrom. The valve 220 is similarly in communication with the interior of the tube 172 through a suitable flexible conduit 234 for venting of gaseous elements therefrom and for admitting compressed air thereto as the treating fluid is removed from the tube.

The vacuum tube 20 is in communication with a suitable vacuum pump 236 through a conduit 238 whereby a vacuum may be applied to the interior of the tube 20. The pump 236 is operably connected with a suitable vacuum condenser 240 as is well known. In addition, it is preferable to provide a plurality of transversely extending longitudinally spaced rollers 242 in the interior of the vacuum tube 20 for facilitating movement of treated timbers 23 through the tube 20 as will be hereinafter set forth.

A pair of suitable connection members 244 and 246 are secured to the outer periphery of the slidable housing 150 in any well known manner for receiving one end of a piston rod 248 and 250, respectively. The piston rods 248 and 250 are reciprocally secured within suitable cylinders, such as hydraulic cylinders 252 and 254, respectively, whereby reciprocation of the piston rods 248 and 250 moves the housing 150 to and fro or reciprocally within the housing 148, as hereinbefore set forth in connection with the slidable housing 26. In addition, the housing 148 is provided with a port 256 generally similar to the port 60 and in substantial axial alignment with the boss 160. A suitable cover member 258 is provided for the port 256 and a piston rod 260 extends through the cover 258 into the port 256. The piston rod is reciprocally carried by a suitable cylinder, such as a hydraulic cylinder 262, and a suitable ram member 264 is carried by the outer end of the rod 260. The ram 264 is preferably supported in the port 256 by a plurality of circumferentially spaced rollers 266 as is well known.

Figure 3:
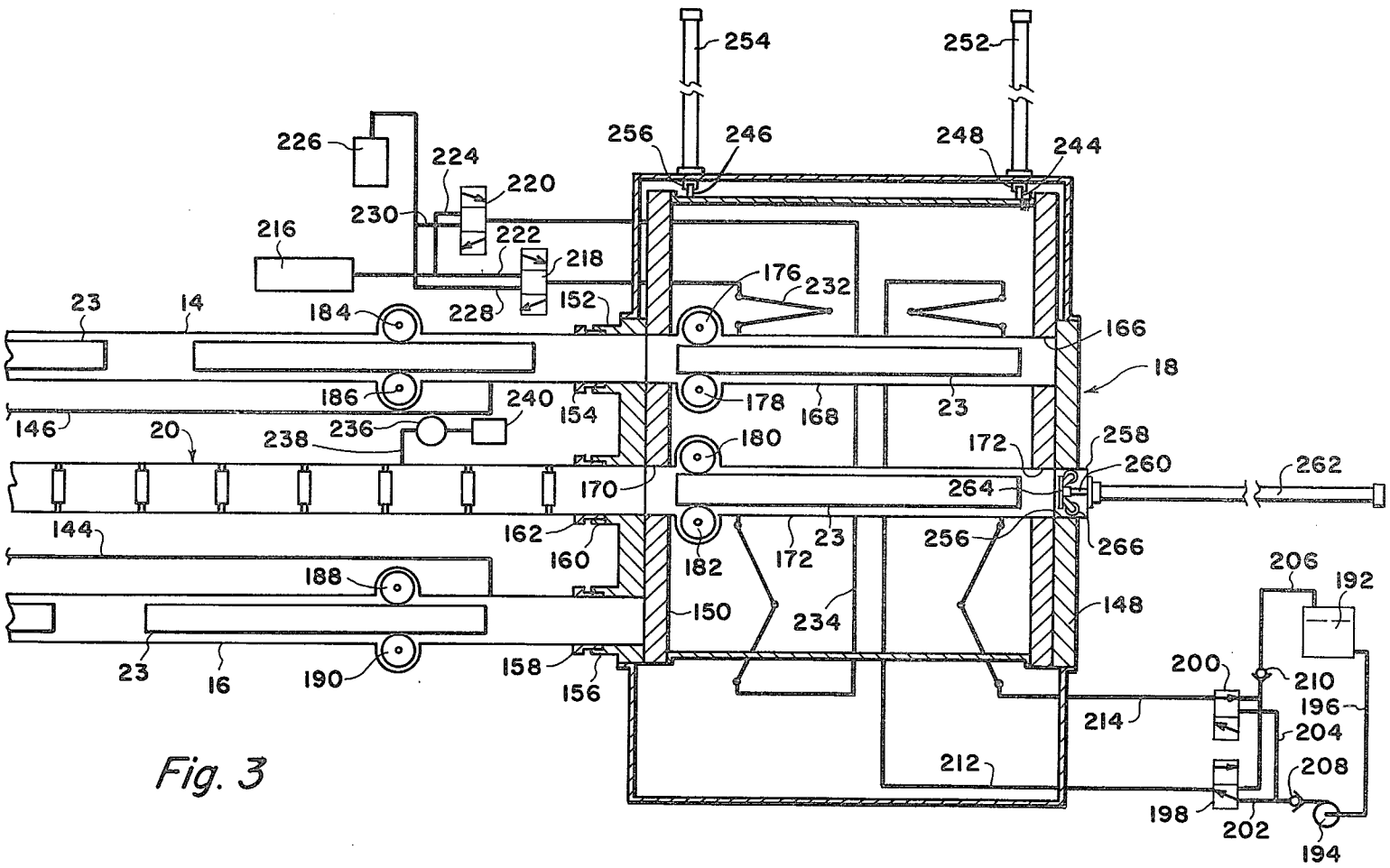
FIG. 3 is a plan view, partly in section, of the receiving portion of a timber treating apparatus embodying the invention and illustrating one operational position thereof.
Figure 4:
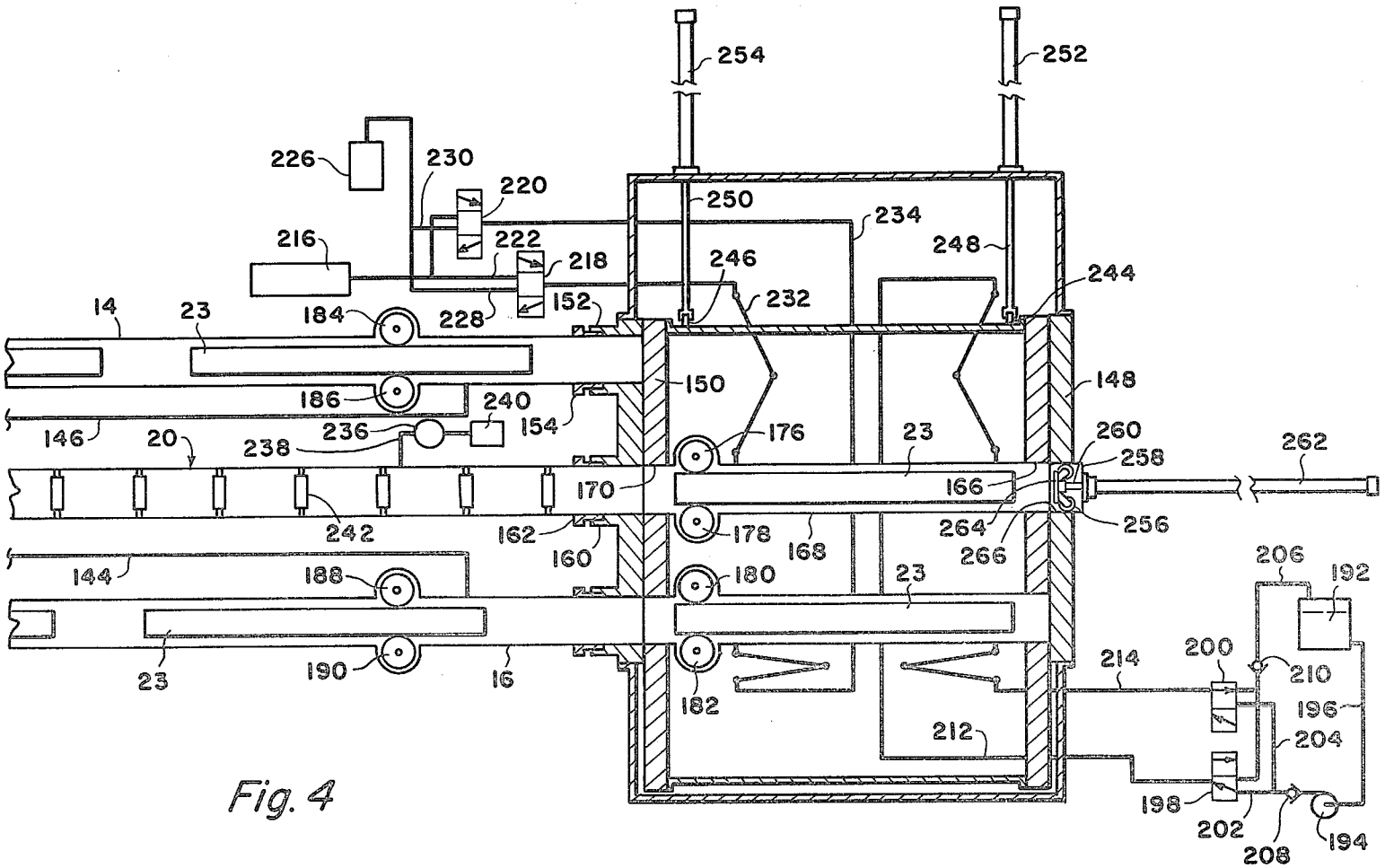
FIG. 4 is a view similar to FIG. 3 illustrating a second position of operation for the apparatus.

When the timbers 23 have been moved longitudinally through the tubes 14 and/or 16, they approach the discharge chamber 18 as particularly shown in FIGS. 3 and 4. In one position of the housing 150 in the housing 148, the tube 168 will be in substantial alignment with the tube 14 and the tube 172 will be in substantial alignment with the vacuum tube 20 as shown in FIG. 3. Of course, it will be apparent that the interior of the tube 168 is filled with the treating fluid and the pressure therein equalized with the pressure within the tube 16 prior to the alignment therebetween. In addition, the treating fluid will be removed from the tube 172 and the pressure in the tube 172 will be equalized with the vacuum pressure in the tube 20 prior to the open communication therebetween. In this operational position of the discharge chamber 18, the timbers 23 approaching the discharge chamber will be engaged by the pinch rollers 184 and 186 for ejection from the tube 14, and the pinch rollers 176 and 178 will engage the emerging timber 23 for moving the timber into the tube 168. At the same time, the timber 23 present in the tube 172 will be engaged by the ram 264 as well as the pinch rollers 180 and 182 for withdrawal of the timber from the tube 172 and insertion of the timber into the vacuum tube 20 for movement longitudinally therethrough on the rollers 242 in the usual or well known manner.

In another position of the housing 150 within the housing 148, the tube 168 will be in alignment with the vacuum tube 20 and the tube 172 will be in alignment with the tube 16, as particularly shown in FIG. 4. In this operational position of the discharge chamber 18 the emerging timber 23 from the tube 16 is engaged by the pinch rollers 180 and 182 and moved into the tube 172, and the timber 23 present in the tube 168 is engaged by the ram 264 as well as the pinch rollers 176 and 178 for withdrawal of the timber from the tube 168 and insertion of the timber into the vacuum tube 20.

Figure 5:
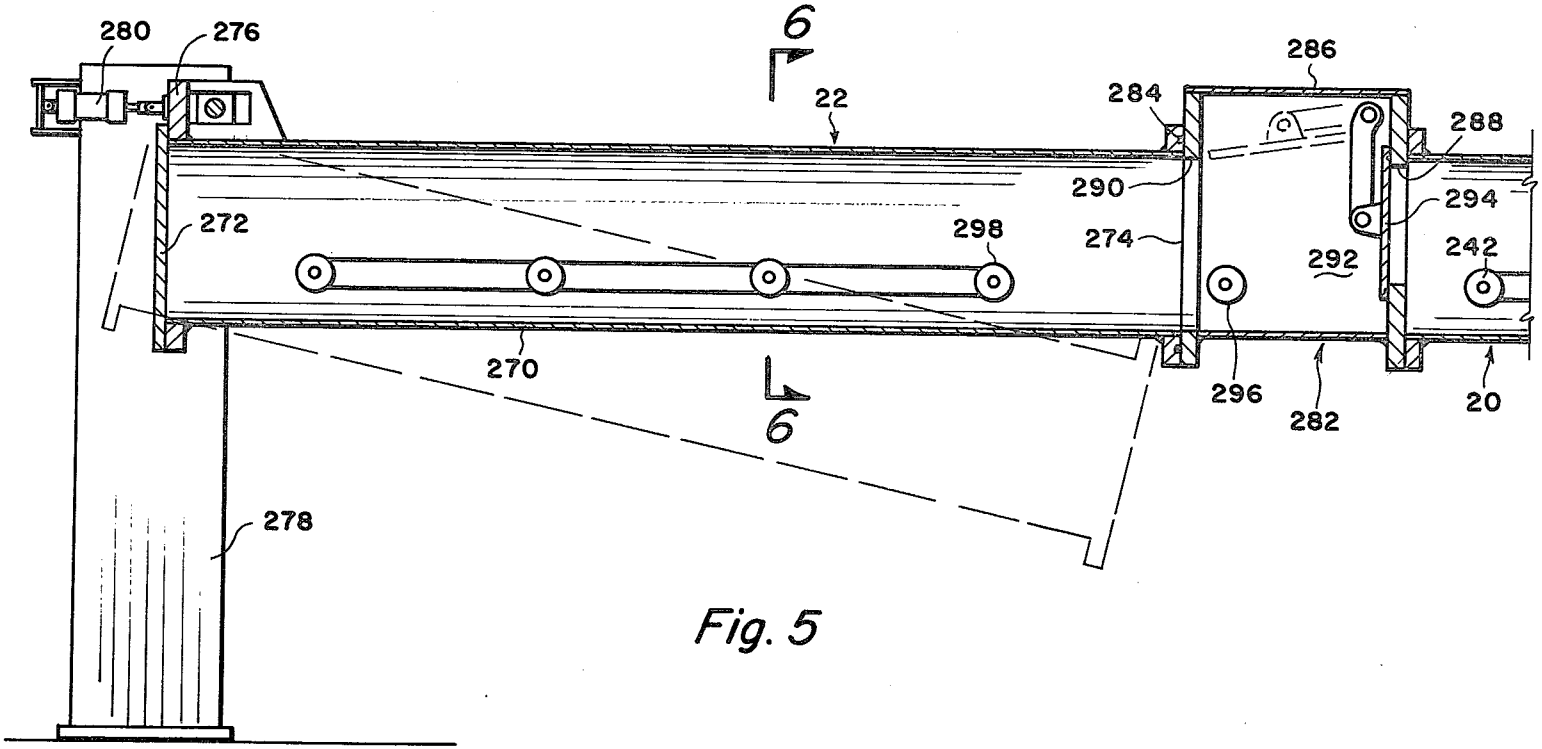
FIG. 5 is a sectional elevational view of the discharge portion of a timber treating apparatus embodying the invention, with one operational position thereof shown in solid lines and another operational position thereof shown in broken lines.
Figure 6:
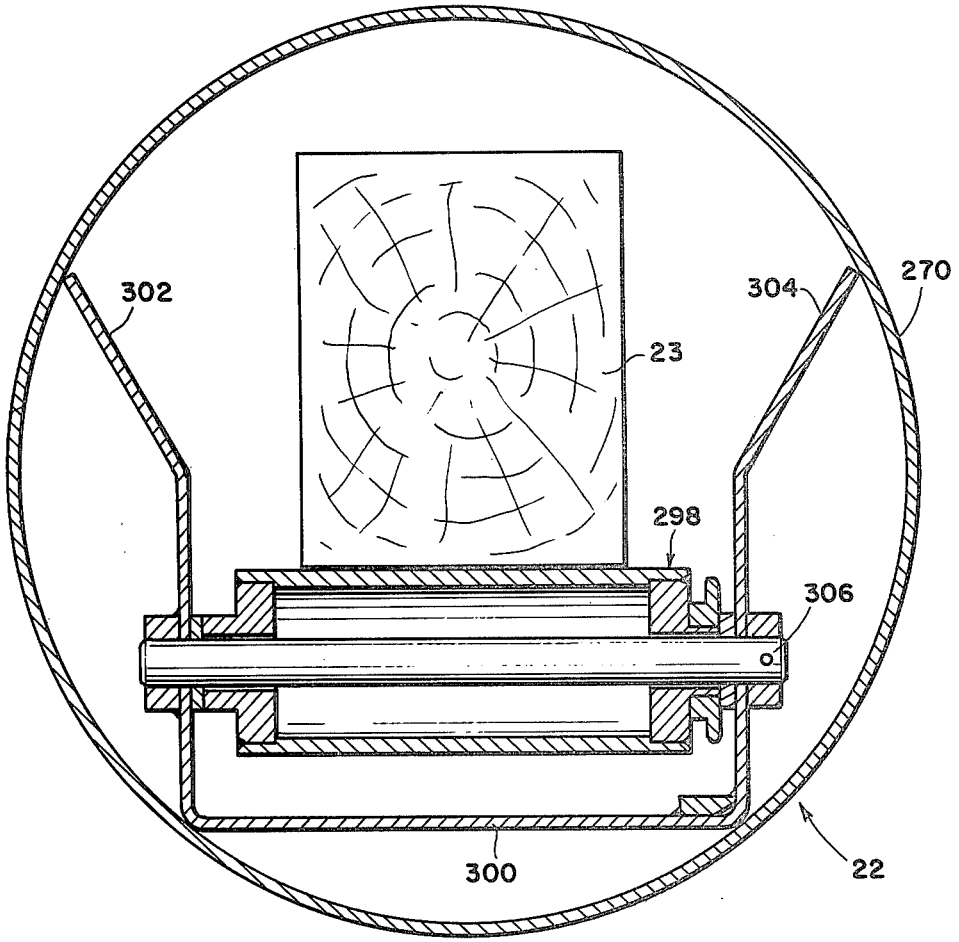
FIG. 6 is a view taken on line 6—6 of FIG. 5.

Referring now to FIGS. 5 and 6, the discharge cylinder 22 comprises a tube member 270 having one end thereof closed by a plate member 272 and the opposite end thereof open as shown at 274. An upstanding flange member 276 is welded or otherwise rigidly secured to the outer periphery of the tube 270 in the proximity of the plate 272 and is pivotally secured to a support post 278 in any suitable manner whereby actuation of a seal clamp cylinder 280 which is mounted on the post 278 will pivot the plate 272 and cylinder or tube 270 from a substantially horizontal position as shown in solid lines in FIG. 5 to a downwardly extending angular position as shown in broken lines in FIG. 5. In the horizontal position of the tube 270, the open end 274 thereof is in communication with the vacuum tube 20 through a suitable vacuum valve assembly 282, and an annular sealing member 284 is provided around the outer periphery of the tube 270 at the open end 274 thereof for sealing against the outer periphery of the vacuum valve 282 in the horizontal position of the tube 270.

The vacuum valve 282 may be of any suitable type, and as shown herein comprises a housing 286 having inlet and outlet ports 288 and 290 therein for passage of fluid therethrough. A chamber 292 is provided between the ports 288 and 290, and a clapper or closure member 294 is hingedly secured within the chamber in any suitable manner for cooperation with the inlet port 288 for providing alternate open and closed positions therefor. The clapper member 294 may be opened and closed with respect to the port 288 in any suitable manner (not shown) and in the closed position thereof as shown in solid lines in FIG. 5, the vacuum pressure within the tube 20 is sealed from the interior of the tube 270 whereby the tube 270 may be pivoted to the downward position therefor. In the open position of the clapper member 294 as shown in broken lines in FIG. 5, the pressure within the vacuum tube 270 is transmitted to the chamber 292, and through the port 290 into the interior of the tube 270 for equalizing the pressure between the tubes 270 and 20. In addition, it is preferable to provide a transversely extending roller 296 similar to the roller 242 in the chamber 292 for receiving the timbers 23 thereacross, and a plurality of similar rollers 298 are preferably longitudinally spaced in the tube 270 for facilitating moving of the timbers 23 therein as will be hereinafter set forth.

Whereas the rollers 298 may be secured within the tube 270 in any suitable or well known manner, as shown in FIG. 6, it is preferable to provide a longitudinally extending channel member 300 having the outer edges thereof supported by and suitably secured to the inner periphery of the tube 270. The outer edges of the channel 300 may be outwardly flared as shown at 302 and 304 for facilitating receiving and centering of the timbers 23 on the rollers 298. The rollers 298 may be suitably journalled on an axle 306 which is secured transversely between the sidewalls of the channel 300 and as clearly shown in FIG. 6.

As timbers 23 are inserted into the tube 20 from the discharge chamber 18, they are moved longitudinally through the tube 20 by the abutting engagement between the ends of adjacent timbers as hereinbefore set forth. Of course, whereas the timbers in the filled pipes 14 and 16 float in the liquid contained therein, it will be apparent that the timbers 23 will rest on the outer periphery of the rollers 242 during movement through the tube 20. The vacuum present in the tube 20 acts on the treating material which has been absorbed by the timbers and dries the timbers to a usuable state. When the timbers 23 have moved longitudinally through the tube 20 and approach the valve 292, the tube 22 is positioned in the horizontal position therefor and the valve 282 may be opened for equalizing the pressure between the tubes 20 and 270. The timbers will then continue their longitudinal movement until a single or a plurality of dried timbers, depending upon the overall length of the tube 270, are disposed within the tube 270. When the tube 270 has been sufficiently filled with dried timbers, the clapper member 294 may be closed against the port 288 for sealing the interior of the tube 270 from the interior of the tube 20. The tube 270 may then be dropped to its downwardly angled position for exposing the open end 274 thereof. The dried timbers may then be removed from the open end 274 in any well known or suitable manner and may be transported to a storage site as desired.

In operation the timbers 23 approach the treating apparatus 10 on the conveyor system 66, and with the housing 26 positioned as shown in FIG. 1, the timbers are individually engaged by the pinch rollers 62 and 64, or any other suitable device, and injected or inserted into the tube 78. The housing 26 is then moved to the position shown in FIG. 2 by actuation of the cylinders 128 and 130, and during the movement of the housing 26 the proper drain/fill valves 82 and 92 are actuated for filling of the tube 78 with the treating fluid, which is preferably in a liquid state. The tube 78 is filled with the fluid at the proper temperature and pressure for efficient use of the treating liquid and corresponding to the treating liquid present in the tubes 14 and 16. When the housing 26 reaches the position shown in FIG. 2, the cylinder 52 is actuated in the usual manner for extending the ram 56 into engagement with the end of the timber 23 disposed in the tube 78 and for pushing the timber from the tube 78 into the tube 16. During this action, the tube 72 has been moved into position in alignment with the port 60 for receiving the next succeeding timber 23 from the conveyor apparatus 66. Of course, at the same time the treating liquid is being admitted into the tube 78, the liquid previously present in the tube 72 is withdrawn whereby the tube 72 will be substantially empty when it reaches the position shown in FIG. 2. The operation may be repeated, with alternate insertion of timbers in the tubes 14 and 16 until the desired number of timbers have been properly treated.

When the timbers 23 are disposed within the liquid treating material provided in the tube 14 or 16, they will float in the liquid and absorb the material in the usual manner. As each new timber is inserted into the tube 14 or 16, the tubes previously deposited therein will be moved longitudinally through the tubes 14 and 16. When the timbers 23 approach the discharge chamber 18, the housing 150 may be positioned as shown in solid lines in FIG. 3 whereby the timbers may be removed from the end of the tube 14 by the pinch rollers 184 and 186, or other such device, and engaged by the pinch rollers 176 and 178 for pulling the timbers individually into the tube 168. The tube 168, of course, has previously been filled with the liquid treating material at the proper temperature and pressure. The housing 150 is then moved to the position shown in FIG. 4 by the actuation of the culinders 252 and 254, and during the movement of the housing 150, the liquid is withdrawn from the tube 168 and liquid is admitted to the tube 172. When the housing 150 is in the position shown in FIG. 4, the ram 264 may be activated by the cylinder 262 in the usual manner for engagement with the end of the timber and for moving the timber from the tube 168 into the vacuum tube 20. The timbers thus sequentially directed into the tube 20 will urge the preceding timbers in a longitudinal direction, across the rollers 242, toward the discharge cylinder 22.

When the timbers 23 are in the tube 20, the vacuum contained therein draws the excess treating material from the timbers for a drying of the timbers, and as the dried timbers reach the valve 282, the valve may be opened for admitting the dried timber or timbers into the tube 270. When the required number of dried timbers have thus been delivered to the tube 270, the valve 282 may be closed and the tube 270 may be pivoted by the actuation of the cylinder 280 for access to the open end 274 of the tube 270 whereupon the dried timbers may be removed from the tube 270 in any well known manner and transported to a storage site.

From the foregoing, it will be apparent that the present invention provides a novel method and means for treating timbers with a liquid treating mateiral wherein the timbers are floated longitudinally through a liquid bath, removed to a drying chamber, and discharged from the drying chamber for transport to storage. The novel method and means is simple and economical.

Whereas the present invention has been described in particular relation to the drawings attached hereto, it should be understood that other and further modifications, apart from those shown or suggested herein may be made within the spirit and scope of this invention.

What is claimed is:

1. A method for treating timbers comprising the steps of conveying individual timbers in succession to a treating station, inserting individual timbers into a carrier, transporting the timbers independently in the carrier into the proximity of a treating chamber having a treating fluid contained therein, ejecting the timber from the carrier for insertion into the treating chamber, repeating the operation with successive timbers whereby each timber inserted into the treating chamber abuts the end of the preceding timber for moving the timbers longitudinally through the treating chamber, ejecting the treated timbers individually from the treating chamber and inserting the said treated timbers individually into a second carrier, moving the carrier into the proximity of a drying chamber, ejecting the treated timber from the second carrier and inserting the timber into the drying chamber, repeating the operation with successive timbers whereby each timber inserted into drying chamber abuts the end of the preceding timber for moving the timbers longitudinally through the drying chamber, removing the dried timbers individually from the drying chamber, and releasing the treated and dried timbers for storage.

2. A method for treating timbers as set forth in claim 1 including the step of providing a supply of treating fluid in the first carrier for surrounding the timber therein during transporting thereof into the proximity of the treating chamber.

3. A method for treating timbers as set forth in claim 2 including the step of heating and pressurizing the treating fluid in the first carrier for equalizing the conditions in the first carrier with the conditions in the treating chamber.

4. A method for treating timbers as set forth in claim 1 including the step of removing any fluid from the second carrier during transportation of the timber therein to the proximity of the drying chamber.

5. A method for treating timbers as set forth in claim 1 wherein a vacuum is provided in the drying chamber for drying of the timbers therein.

6. A method for treating timbers as set forth in claim 1 wherein the timbers are floated in the treating fluid contained within the treating chamber for absorbing the treating fluid during the longitudinal movement through the treating chamber.

7. A method for treating timbers as set forth in claim 1 wherein the step of removing the dried timbers from the drying chamber comprises equalizing the pressure between the drying chamber and a discharge cylinder, moving the dried timber from the drying chamber into the discharge cylinder, sealing off communication between the drying chamber and the discharge cylinder, and opening the discharge cylinder for removal of the dried timber therefrom.

8. A method for treating timbers as set forth in claim 1 and including the step of maintaining a constant supply of treating fluid in the treating chamber.

9. A method for treating timbers as set forth in claim 8 and including the step of maintaining the constant supply of treating fluid in the treating chamber at a proper temperature and pressure for an optimum treating operation.

10. An apparatus for treating timbers comprising treating chamber means having treating fluid contained therein, a drying chamber, first movable carrier means having one position for receiving a timber therein and a second position for ejecting of the timber therefrom and inserting of the timber into the treating chamber means, second movable carrier means having one position for receiving a treated timber from the treating chamber means and a second position for ejecting of the treated timber therefrom and inserting of the treated timber into the drying chamber, and discharge means selectively in communication with the drying chamber for receiving dried timbers therefrom for discharge of said dried timbers from the apparatus.

11. An apparatus for treating timbers as set forth in claim 10 wherein the treating chamber means comprises at least one pressure sealed treating chamber for receiving a plurality of timbers therein in end-to-end relation for movement longitudinally through the treating chamber whereby the timbers absorb the treating fluid.

12. An apparatus for treating timbers as set forth in claim 10 and including ram means cooperating with the first carrier means for ejecting the timbers thereform and inserting of the timbers into the treating chamber means.

13. An apparatus for treating timbers as set forth in claim 10 and including ram means cooperating with the second carrier means for inserting of the dried timbers into the drying chamber.

14. An apparatus for treating timbers as set forth in claim 10 wherein the drying chamber means includes roller means disposed therein for facilitating longitudinal movement of the treated timbers therethrough during a drying operation.

15. An apparatus for treating timbers as set forth in claim 10 and including means for maintaining an adequate supply of the treating fluid in the treating chamber.

16. An apparatus for treating timbers as set forth in claim 16 and including means for maintaining the supply of treating fluid in the treating chamber at a proper temperature and pressure for assuring an efficient treating operation of the timbers therein.

17. An apparatus for treating timbers as set forth in claim 10 wherein the discharge means comprises a discharge cylinder in selective communication with the drying chamber, vacuum valve means interposed between the discharge cylinder and the drying chamber for alternately equalizing the pressures therebetween and precluding communication therebetween, and means providing for access to the interior of the discharge cylinder in the sealed off position thereof with respect to the drying chamber whereby the dried timbers may be removed from the discharge cylinder.

18. An apparatus for treating timbers as set forth in claim 10 and including conveyor means for moving timbers to be treated into the proximity of the first carrier means.

19. An apparatus for treating timbers as set forth in claim 19 and including means interposed between the conveyor means and the first carrier means for moving the timbers from the conveyor means into the first carrier means.

20. An apparatus for treating timbers as set forth in claim 10 and including means operably connected with the first carrier means to provide said movement therefor.

21. An apparatus for treating timbers as set forth in claim 10 and including means operably connected with the second carrier means to provide said movement therefor.

* * * * *